United States Patent [19]

Birkhofer

[11] Patent Number: 4,741,466

[45] Date of Patent: May 3, 1988

[54] MACHINE FOR ATTACHING RIVETS, SNAP FASTENERS OR SIMILAR

[75] Inventor: Herbert Birkhofer, Brunswick, Fed. Rep. of Germany

[73] Assignee: Scovill Apparel Fasteners Inc., Watertown, Conn.

[21] Appl. No.: 883,115

[22] Filed: Jul. 8, 1986

[51] Int. Cl.[4] ..... B21J 15/28

[52] U.S. Cl. ..... 227/4; 227/2

[58] Field of Search ..... 227/2, 4, 8, 15, 32

[56] References Cited

U.S. PATENT DOCUMENTS 4,343,423 8/1982 Sauermilch ..... 227/8
4,376,504 3/1983 Birkhofer ..... 227/32
4,378,900 4/1983 Sauermilch ..... 227/8
4,436,238 3/1984 Seki ..... 227/15

FOREIGN PATENT DOCUMENTS 2341258 2/1975 Fed. Rep. of Germany .

*Primary Examiner*—E. R. Kazenske
*Assistant Examiner*—James L. Wolfe
*Attorney, Agent, or Firm*—Dallett Hoopes

[57] ABSTRACT

A machine is disclosed for attaching rivets, snap fasteners or similar fasteners to garments, the machine including an upper tool, a lower tool and a ram for advancing the upper tool. Holding tongs for the fasteners are carried by a guide rod which engages a brake carried by the tool ram. An operating switch releases the guide rod and a second switch is actuated when the tongs are in their lowermost position to actuate the upper tool ram.

13 Claims, 12 Drawing Sheets

17
15
16
14
13
28
10
8
37
29
31
30
7
32
75
36
44
9
49
35
34
46
6
33
53
82
5
4
20
19
21
23
11
22
66
43
25
44'
26
69
3
38
39
40
41
70
73
74
71
76
80
79
78
77
50
47
48
57
51
58
56
45
53

FIG. 7
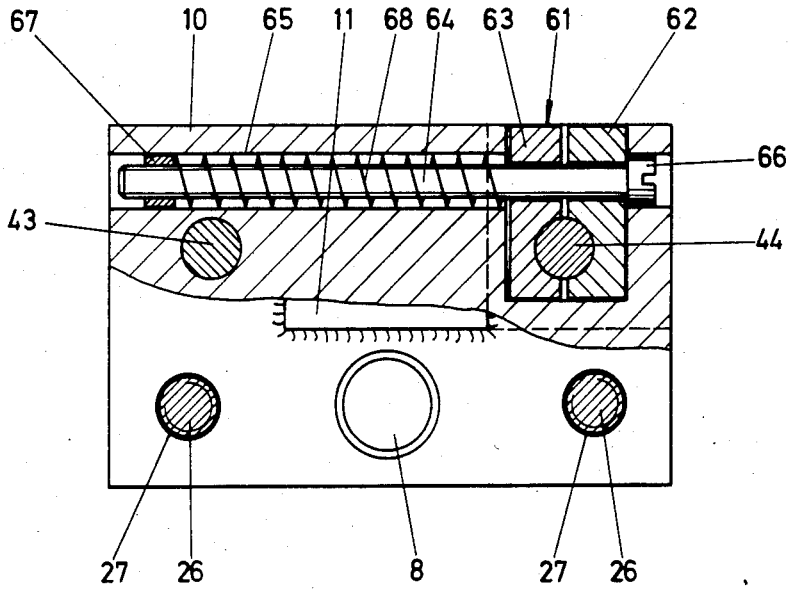
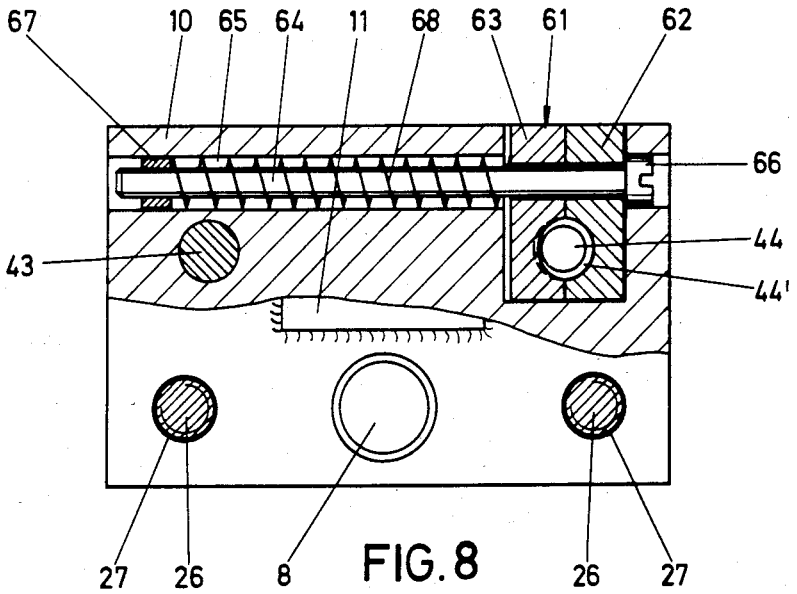
FIG. 8

84'
84
88
90
85
89
91
86
90
88
89
91
93
104
94
83
92
95
87''
87
87'

MACHINE FOR ATTACHING RIVETS, SNAP FASTENERS OR SIMILAR

BACKGROUND OF THE INVENTION

The invention concerns a machine for attaching rivets, snap fasteners or similar, with an upper tool which upon release actuation moves toward the lower tool, and with tongs, for the rivet or similar upper part, coordinated with the upper tool and likewise forming the finger guard, the downward motion toward the lower tool of the tongs being controlled by an operating switch. Such a design is known from the German Patent Disclosure No. 2,341,258, wherein the tongs are attached to a guide rod which, in turn, is coupled via a lever system with a Bowden cable running to a foot switch fashioned as the operating switch. As the foot switch is actuated, the guide rod performs via the lever system a positive downward motion, along with the tongs, toward the lower tool. When stepping hard on the foot switch, the fingers of the operator may be pinched in due to the positive control. Another disadvantage of this design is seen in the fact that the lever system is very expensive and may result in operational malfunctions.

SUMMARY OF THE INVENTION

The problem underlying the object of the invention is to so design a machine of the general type described which embodies a simplified design of the parts pertaining to the finger guard and in which the tongs will always approach the lower tool at a consistent force.

The present invention is predicated in part on the concept of providing an attaching machine including an upper tool and a lower tool, a guide rod for supporting tongs, and means for controlling movement of the guide rod and upper tool. More particularly, an upper tool ram advances the upper tool toward the lower tool. This upper tool ram carries a brake for releasably holding the guide rod. An operating switch is provided to activate control means for releasing the guide rod from this brake. A second switch is actuated in the lower portion of the tongs to activate the upper tool ram.

One advantage of the present machine is that its structure is simplified, contributing to saving manufacturing costs. Additionally, the tongs approach the lower tool always at a constant force, irrespective of the force with which the operating switch is actuated. The guide rod supporting the tongs is upon actuation of the operating switch released from its braked position, for moving down, so that any pinching of fingers leading to injury can thus no longer occur. The switch for the release actuation of the upper tool is operated only in the lower limit position of the tongs. Finger access between lower tool and tongs is then blocked, so that no danger of injury exists as the upper tool ram cycles down. The reciprocating movement of the upper tool ram can be utilized for restoring the tongs in home position.

A variant is characterized by providing a brake shoe which in the lower position of the upper tool ram assumes its braking position relative to the guide rod. In this lower position, the brake shoe assumes its braking position relative to the guide rod and entrains it in the upward motion. Next, another riveting operating can be performed, provided that new rivet components have been fed to the tongs and also to the lower tool after the upward motion of the upper tool ram.

A further advantage is obtained by utilizing an operating switch control which moves a solenoid core down to shift the guide rod until releasing the brake. The actuating pulse is thus transmitted to the solenoid, and controls the guide rod release from braked position relative to the brake shoe, always at constant force.

Preferably, the core bears adjustably on a springed pressure component on an arm of the guide rod. This makes it possible to very accurately determine the timing of the guide rod drop with the attached tongs.

A smooth mode of operation is assured in that the arm of the guide rod encounters a cushion which stops the drop of the tongs. This cushion results in a gentle treatment of the material to be equipped with rivets.

In the preferred embodiment the arm of the guide rod also has an adjustment finger which engages the switch for the release actuation. The activation of the upper tool ram can in this way be adjusted accurately to the position of the tongs in their lower position.

To insure that the guide rod entrained by the upper tool ram is always brought exactly into home position relative to the brake shoe, the down motion of the guide rod is limited by an adjustable stop, irrespective of the upward motion of the ram. Therefore, the tongs and upper tool always assume in the upper limit position the same position to one another.

In the preferred embodiment the braking force of the brake shoe consisting of two jaws is adjustable. The braking force adjustment adapts to the force of the solenoid and the weight of the guide rod and tongs.

In a modification it has been found advantageous to provide the brake shoe with an automatically closing jaw; the guide rod, entrained upward by the upper tool ram, extends in downward position into the brake shoe while in upward direction it can freely pass the brake shoe. Upon actuation of the operating switch and the brake release occurring thereby, the guide rod moves down. It remains in the brake shoe also in the down position. Once the tongs have assumed their guarded position, the ram drive is activated shifting the brake shoe relative to the guide rod. Starting from the lower limit position of the ram, the brake shoe entrains the guide rod as it moves in an upward direction. The brake jaw arrangement is such that a downward stress of the guide rod will increase the braking force. In contrast, an opposite shift of the guide rod exerts no appreciable braking effect. The automatically closing brake jaw is controlled by means of a release lever. The latter is designed as a swing lever actuated by solenoid, making it possible to realize favorable gearing ratios. The connection between release lever and the automatically closing brake jaw is effected by way of slot/pin engagement. Along with a swing motion of the release lever caused by the solenoid, the brake jaw is moved into release position, against spring load and parallel to itself, permitting the subsequent down movement of the guide rod. A "soft braking" can be accomplished by means of the two switching elements provided on the guide rod, along with the opposite switching components interacting with them. This means that the tongs are being braked shortly before reaching their guarded position while moving down, in that the upper switching element causes the swing lever solenoid switch to assume release position so that the automatically closing brake jaw becomes effective. Following a short braking travel, the lower switching element interacting with the lower opposite switching element activates the ram drive. The switching elements and the opposite switching elements are preferably adjustable so that the braking distance is adjustable as well.

Two embodiments of the invention will be explained hereafter with the aid of FIGS. 1 through 13.

BRIEF DESCRIPTION OF THE DRAWINGS

FIG. 7 is a horizontal cross-sectional view of the upper area of the machine at the level of the brake shoe clamping the upper end of the guide rod;

FIG. 8 is a view corresponding to FIG. 7, where the guide rod has left the clamping shoe mounting;

Figure 1:
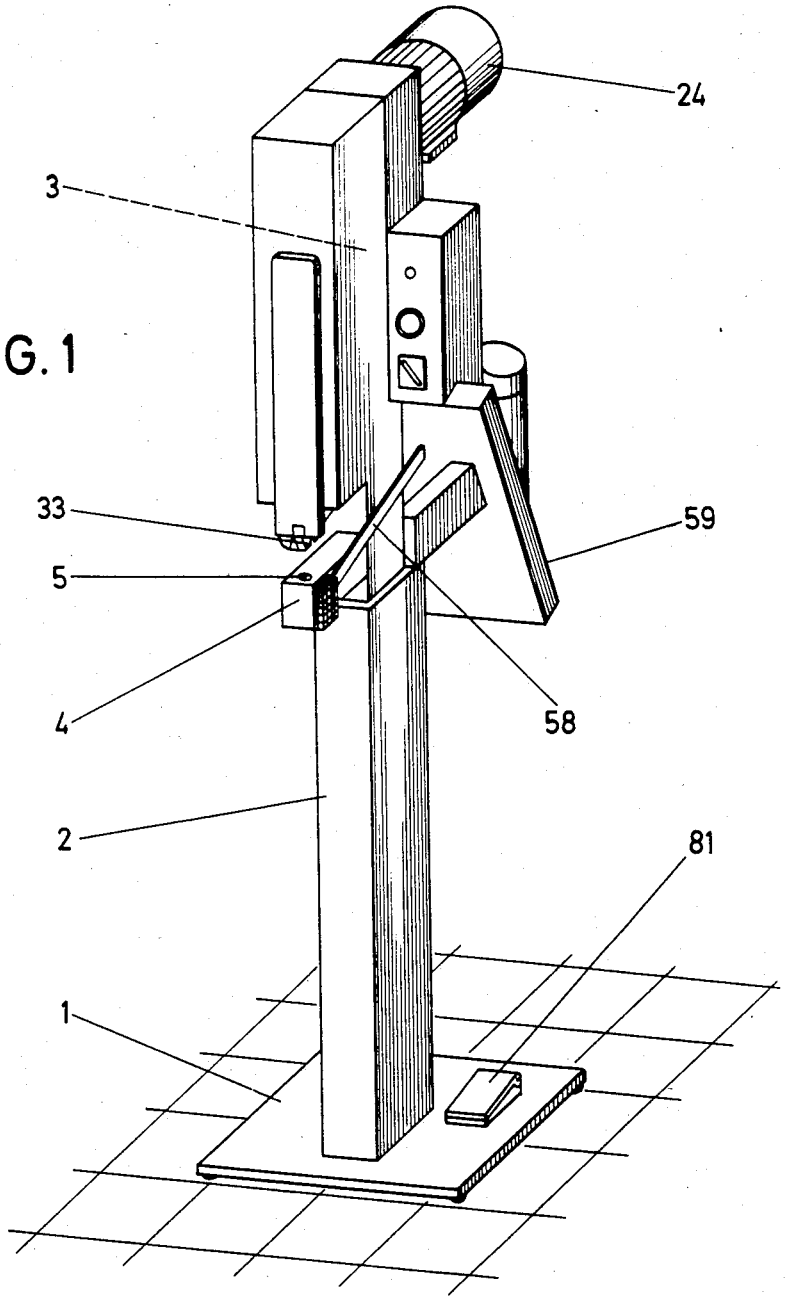
FIG. 1 is a perspective view of a machine according to the first embodiment, for setting rivets, snap fasteners or similar, with the upper tool cycled up.
Figure 2:
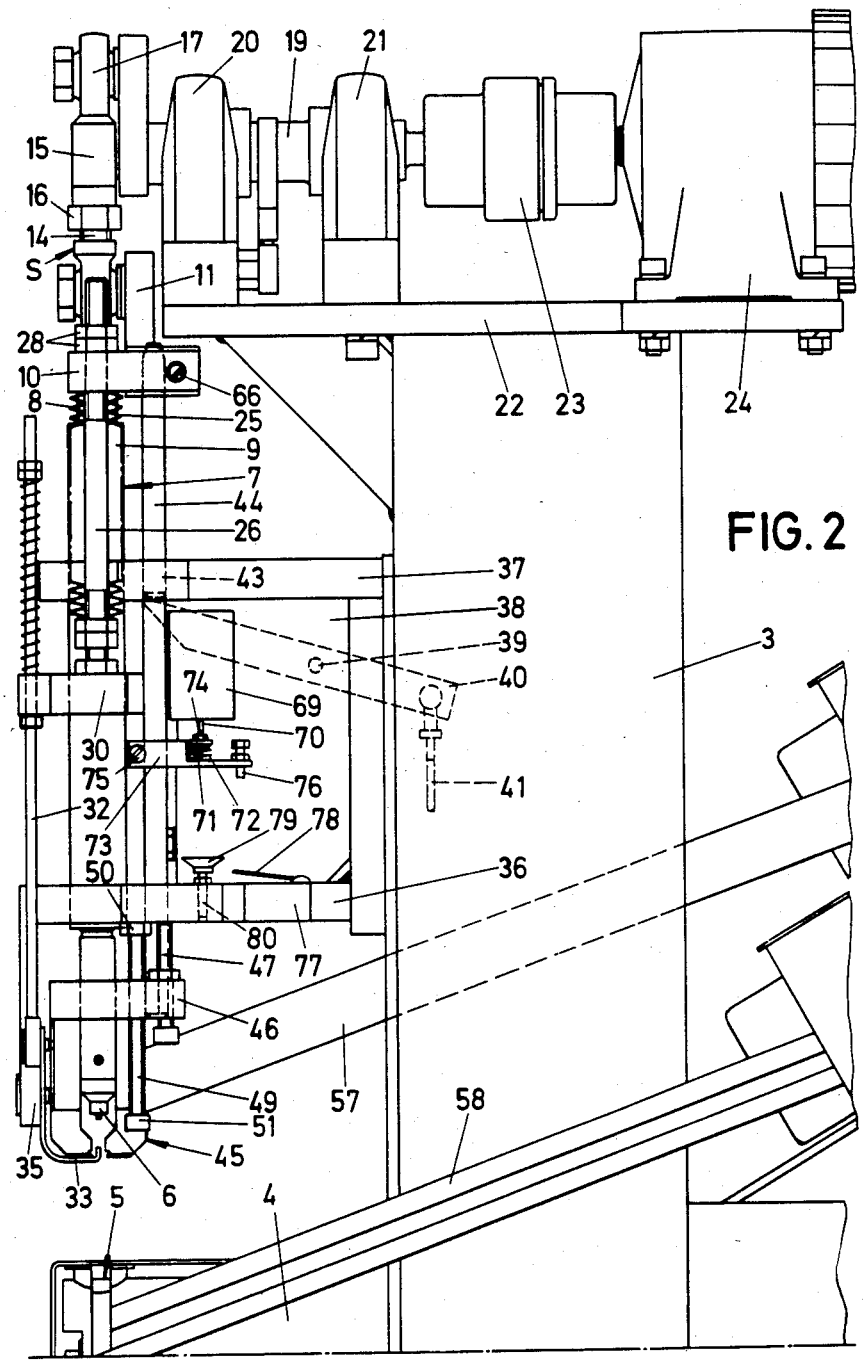
FIG. 2 is an elevational view of the upper area of the machine in home position.
Figure 3:
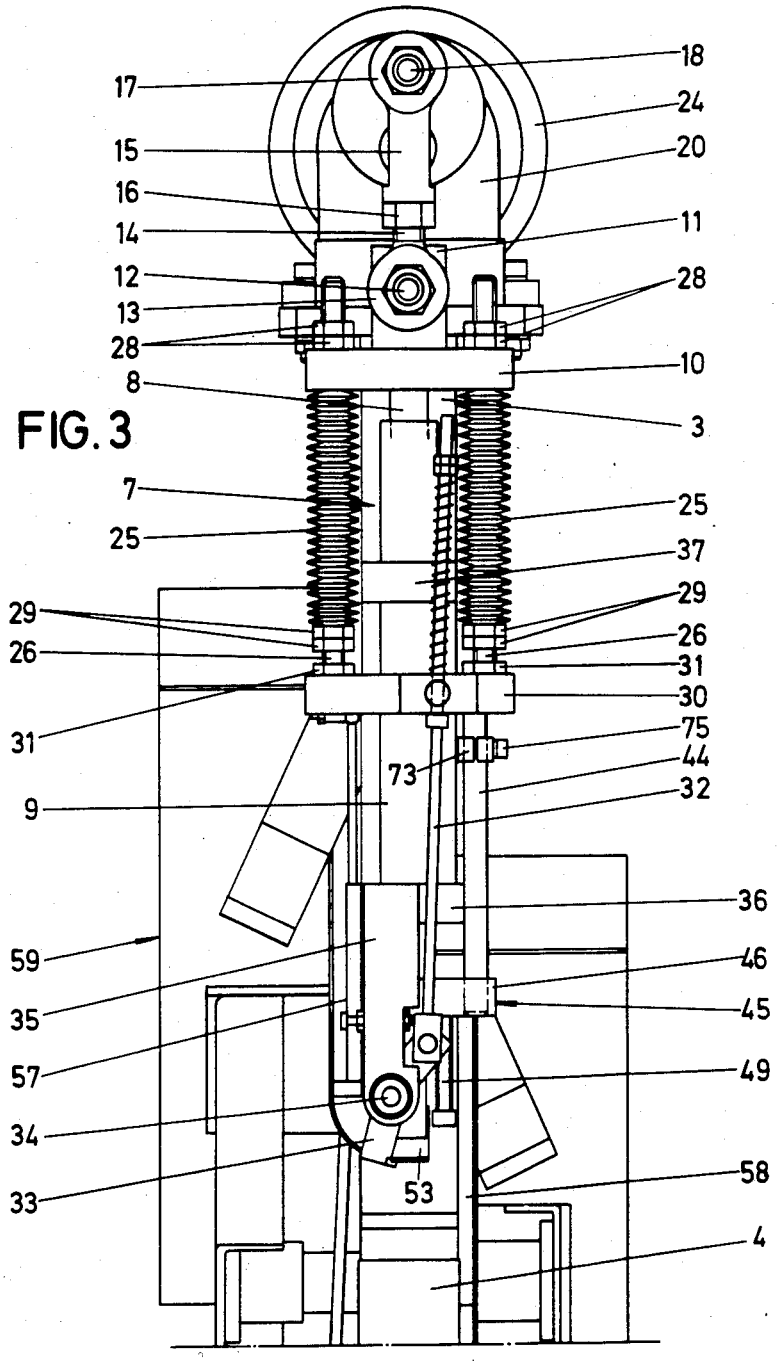
FIG. 3, is a side view of the machine shown in FIG. 2.
Figure 4:
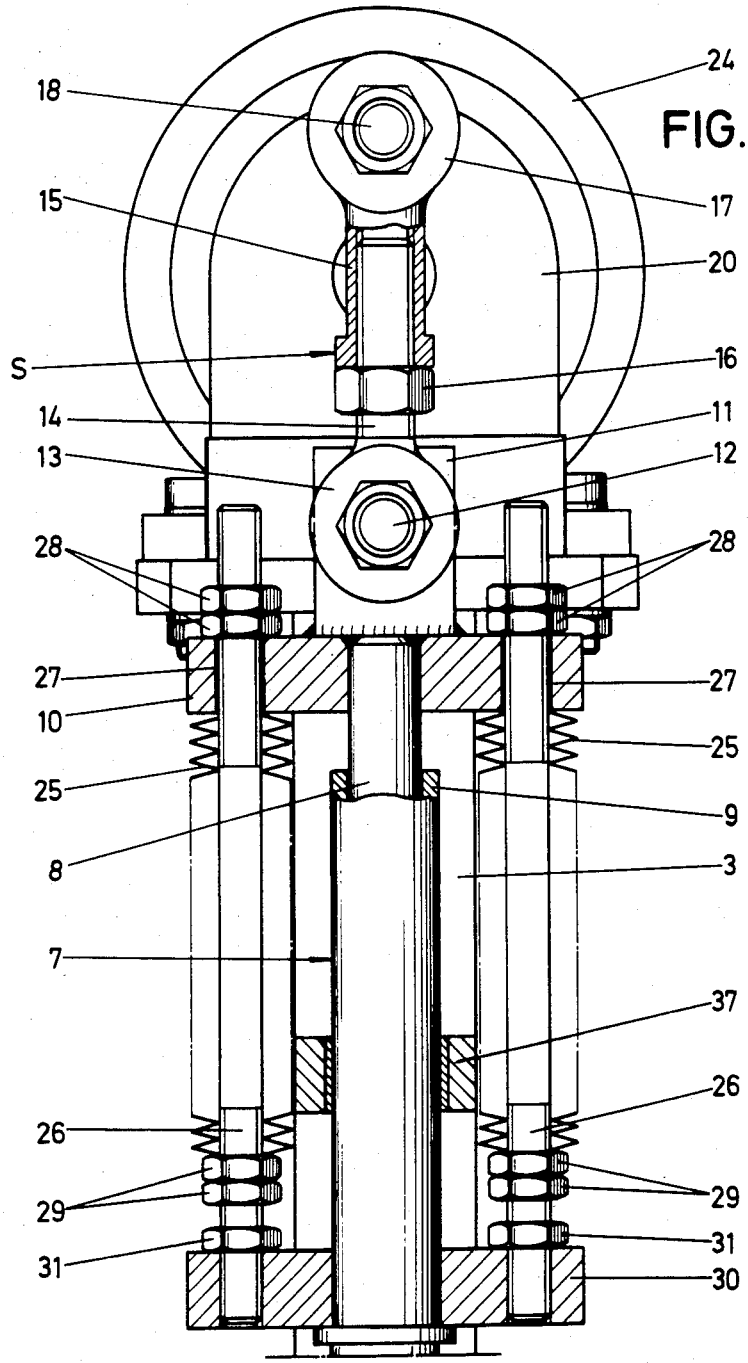
FIG. 4 is a vertical section of the area of the telescopic ram guide.
Figure 5:
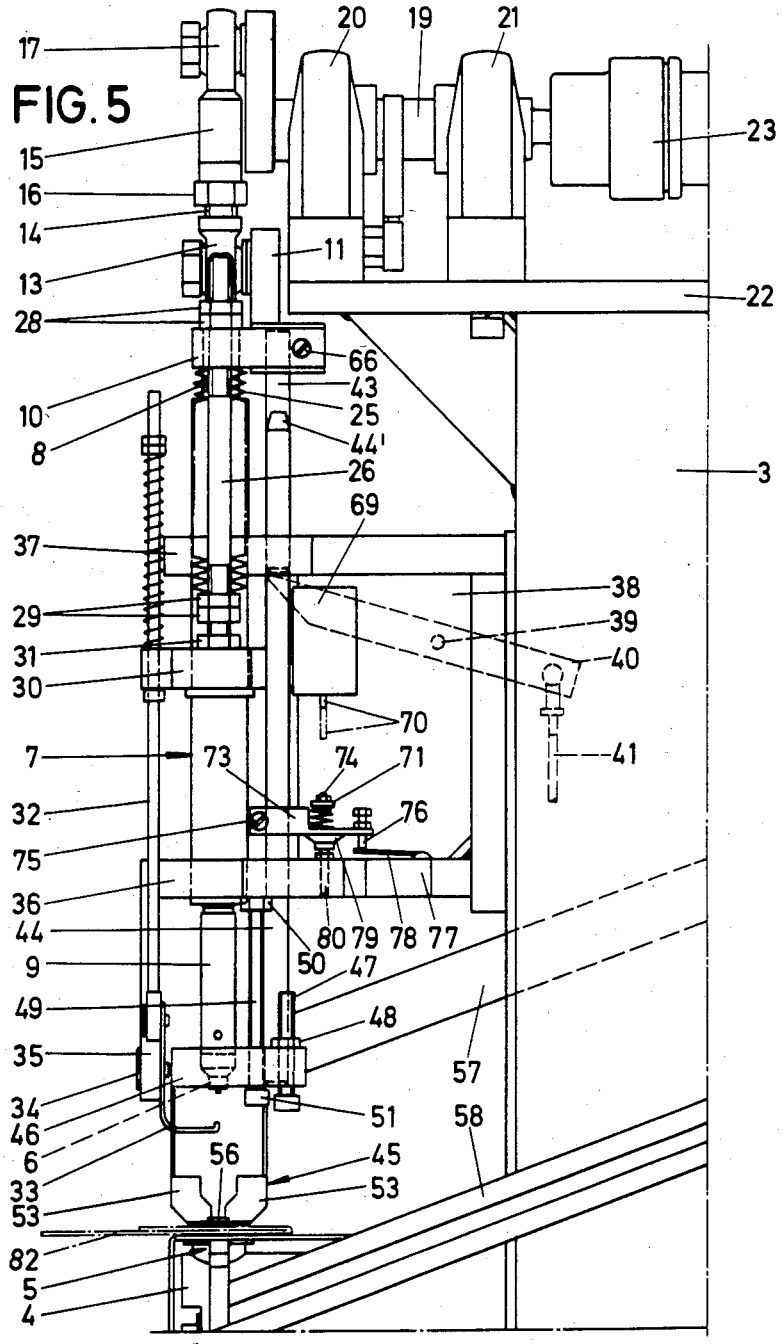
FIG. 5, is an elevational view corresponding to FIG. 2, where the guide rod with tongs has been released for dropping, by the solenoid.
Figure 6:
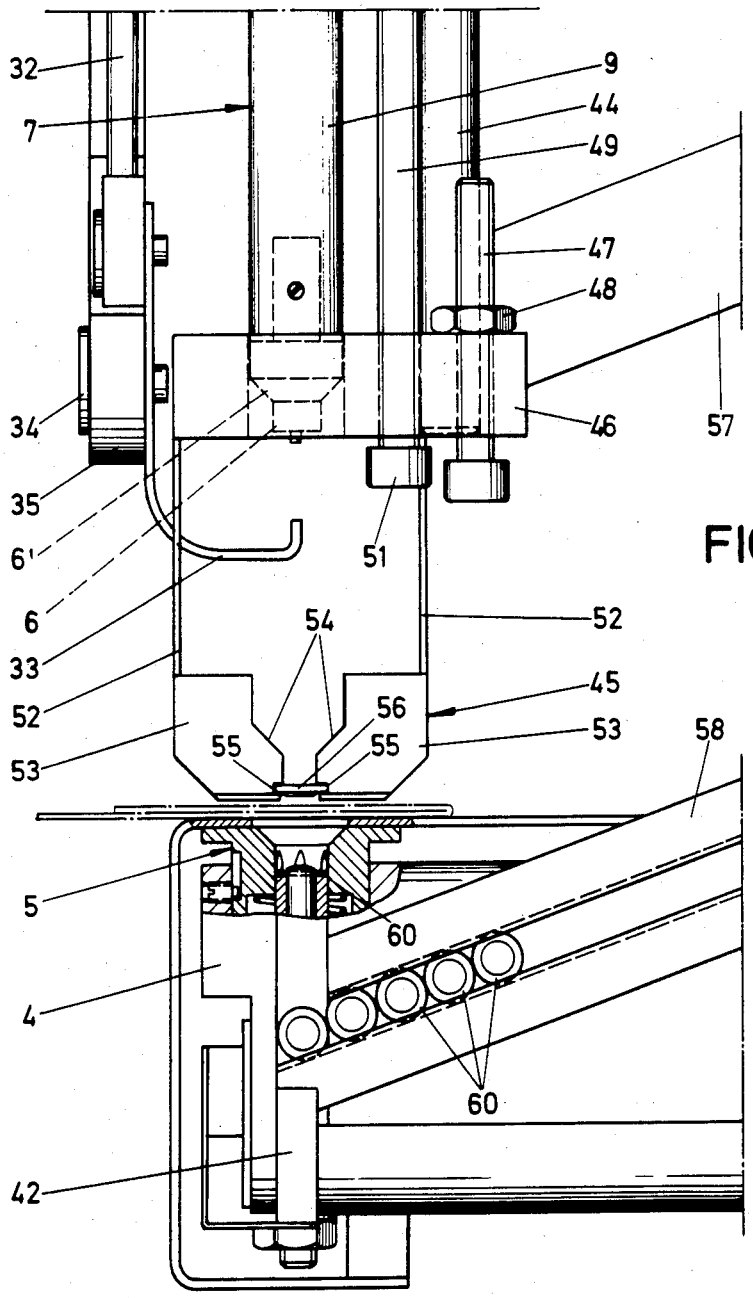
FIG. 6, is an enlarged elevational view partly in section of a portion of the apparatus illustrated in FIG. 5, in approximately actual size, in the area of the lower tool and the lowered tongs.

Illustrated in FIGS. 1 through 8, the machine according to the first embodiment comprises a column 2 originating from a base 1. A column head 3 originates from the upper front face of the column. Attached to the lower end of the column head is a cantilever arm 4 for receiving a lower tool 5.

Aligned with the lower tool 5, a tool 6 extends above it. It is fastened on a telescopic ram guide 7 which is composed of two parts 8 and 9. The one part 8 originates centrally from a horizontal force application plate 10 and forms the inside mandrel of the second, tubular part 9. Directed upward, a small pillow block 11 is mounted on the force application plate 10. Its bearing pin 12 passes through an eye 13 which is carried by a threaded pin 14. The latter engages the internal threading of a crank arm 15 and is rotationally fixed by means of a nut 16. Provided in this way is an adjustable-length turnbuckle type crank arm S. The crank arm 15 forms a bearing 17 through which extends a pin 18 of a crankshaft 19. The crankshaft is rotatably mounted in two bearings 20, 21 which are installed on the face plate 22 of the column head 3. The crankshaft 19 connects by way of a clutch 23 with a drive motor 24 which is arranged on the face plate 22.

The force application plate 10 transfers the ram force to the lower part 9 by way of two banks of springs 25 consisting of Belleville springs. The spring banks are contained on two adjustable mandrels 26 which are arranged symmetric to the telescopic ram guide 7, pass through the bores 27 in the force application plate 10, and support on their free upper end protruding beyond the force application plate 10 two jam nuts 28. One bearing point for the spring banks 25 is the underside of the force application plate 10, while the other bearing point is formed by two jam nuts 29 arranged on the adjustable threaded mandrels 26. The nuts are contained in the vicinity of a ram plate 30 into which the mandrels 26 are screwed and secured by means of a nut 31. The spring pressure of the spring banks can be varied by turning the nuts 29. The other nuts 28 bearing on the force application plate 10, on the other hand, permit by their adjustment a change of the distance of the upper tool 6 relative to the lower tool 5, in conjunction with a simultaneous change of the spring pressure. Moreover, the mandrels 26 can be so turned by means of the jam nuts 28, after loosening the nuts 31, that only a height change of the ram plate 30 and thus the upper tool ram will be obtained. A rough spacing change can be performed by screwing the threaded pin 14 farther in or out of the crank arm 15. This will not change the spring pressure of the spring packages 25 either.

Firmly connected with the lower tubular part 9 of the telescopic ram guide 7, the ram plate 30 controls through a springed rod 32 a rocker type insertion lever 33 which is coordinated with the upper tool. The insertion lever 33 pivots on a pin 34 which extends through the end of an arm 35 of a bearing plate 36. Another bearing plate 37 extends in a parallel arrangement above the bearing plate 36, the two plates forming sliding guides for the tubular part 9 of the telescopic ram guide 7 and being permanently connected with the column head 3. The two plates 36, 37 feature between themselves a junction plate 38 which on a pivot 39 supports a control lever 40, from which a follower rod 41 runs to the cantilever arm 4 controlling there in a not illustrated manner a movable loading finger 42. The control lever 40 is shifted by the lower free front end of a rod 43 which extends down from the force application plate 10.

A guide rod 44 extends parallel to the rod 43 and supports tongs 45 on its lower end. In detail, the tongs 45 are connected to a support plate 46 in which the lower end of the part 9 of the telescopic ram guide 7 is shiftably mounted.

The support plate 46 is permanently connected with the guide rod 44. An integral part of the support plate 46 is an adjustable stop 47 limiting the upward motion of the guide rod 44. The adjustable stop 47 is fashioned as a screw passing through a threaded bore in the support plate and secured there rotationally by a nut 48. In the upper position of the guide rod 44 or the tongs 45, respectively, the screw bears with its front face on the underside of the bearing plate 36; compare FIG. 2.

Arranged parallel to the screw forming the adjustable stop 47, an adjustable screw 49 extends from the bearing plate 36 and passes freely through the support plate 46. A nut 50 prevents the adjustable screw 49 from turning. The head 51 of the adjusting screw interacts with the underside of the support plate 46.

The tongs 45, on leaf spring sections 52 extending downward, support jaws 53 which form on the inside control bevels 54 interacting with the truncated cone surface 6' of the upper tool 6. Following the control bevels are receiving niches 55 for a rivet top part 56.

The loading of the rivet top parts 56 in the receiving niches 55 is accomplished with an insertion lever 33.

The rivet top parts 56 are conveyed through a feed channel 57 which extends parallel to a feed channel 58. Both feed channels 57, 58 are inclined and originate from a magazine 59 from which the orderly feeding of the rivet top parts 56 and the rivet bottom parts 60 takes place. The upper end 44' of the guide rod 44 is tapered and held by a clamping shoe 61. Cantilevered sideways, the latter is mounted on the force application plate 10 and composed of two jaws 62 and 63. The one jaw 62 is permanently coordinated with the force application plate 10, whereas the other jaw 63 can be shifted transverse to the longitudinal direction of the guide rod 44. A transverse adjustment screw 64 extends through both jaws 62, 63 while arranged in a through-bore 65 in the plate 10 and bearing with its head 66 on the fixed jaw 62. The free end of the adjustment screw 64 extends through a nut 67. Located between the nut and the adjustable braking jaw 63 is a compression spring 68. The prestress of the compression spring 68 can be varied by turning the adjustment screw 64, so that the brake jaw 63 will act upon the guide rod 44 with greater or lesser force. The braking force is selected so that the guide rod 44 with the attached tongs 45 will not inadvertantly be released from the braked position relative to the upper tool ram.

Attached to the junction plate 38, a solenoid 69 serves to shift the guide rod 44. Its core acts upon a pressure component 71 which by way of a compression spring 72 is springed relative to an arm 73 of the guide rod 44. Coordinated with the pressure component 71 is an adjustment screw 74 for adaptation to the position of the core 70. Also, the height of the arm 73 can be adjusted relative to the guide rod 44 by means of a set screw 75.

The free end of the arm 73 supports an adjustable finger 76 for engaging the switch 77 activating the ram drive 24. The adjustable finger 76 is fashioned as well as a screw and acts with its bottom end on the switching element 78 of the switch 77 which is installed on the bearing plate 76. The latter also accommodates a cushion 79 which is arranged on a screw 80 which is adjustable in height.

The operating mode is as follows: Once the lower tool 5 and the tong jaws 53 are properly loaded with rivet parts 56 or 60, respectively, the riveting operation can be initiated by means of the foot switch 81. As the foot switch 81 is operated, a pulse is sent to the solenoid 69 causing its core 70 to move down in the position indicated by dash-dot lines in FIG. 5. This causes the arm 73 to be acted upon via the pressure component 71, entraining the guide rod 44 with the attached tongs 45 downward. The upper end of the guide rod 44 is in the process released from the braked position relative to the brake shoe 61 and is allowed to drop. In the end phase of the drop, the arm 73 encounters the cushion 79 (compare FIG. 5), so that the tongs 45 are positioned a short distance from the outrigger 4 supporting the lower tool 5. The spacing conforms to safety regulations and does not permit the introduction of a so-called gauging finger. In this lower position of the tongs 45, the adjustable finger 76 of the arm 73 likewise has shifted the switching element 78 of the switch 77, thereby causing the drive motor 24 to receive a pulse and to rotate the crankshaft 19, in connection with the down motion of the telescopic ram guide 7. The upper tool 6 acts in the process, with its truncated cone-shaped flank 6' upon the control bevels 54 of the tong jaws, spreading these apart. The rivet top part 56 has then been gripped by the upper tool 6 and can be connected with the rivet bottom part 60, by coordinating these two parts for instance with a garment 82 illustrated by dash-dot lines in FIG. 5. The down motion of the tongs is limited by the head 51 of the adjustment screw 49. The closing force acting on the rivet parts 56, 60 is adjustable as required.

Simultaneous with this down motion, the force application plate 10 has been shifted, and with it the clamping shoe 61. The latter seats on the tapered end 44' of the guide rod 44 and assumes its braking position relative to it, entraining the guide rod 44 including the tongs 45 in the subsequent upward motion of the upper tool ram 7. The upward motion of the guide rod 44 is limited by an adjustable stop 47 striking on the underside of the bearing plate 36. This restores again the home position, with rivet parts having been fed to the tong jaws 53 and the lower tool 5 in the end phase of the motional sequence, through the inserting lever 33 or the loading finger 42, respectively. The solenoid 69 with its coil 70 is then in home position as well so that a new riveting cycle can be initiated.

The control lever 40 and the rod 32 are positively entrained only in one direction. Therefore, they permit manual actuation enabling the loading of rivet parts without ram movement.

Figure 9:
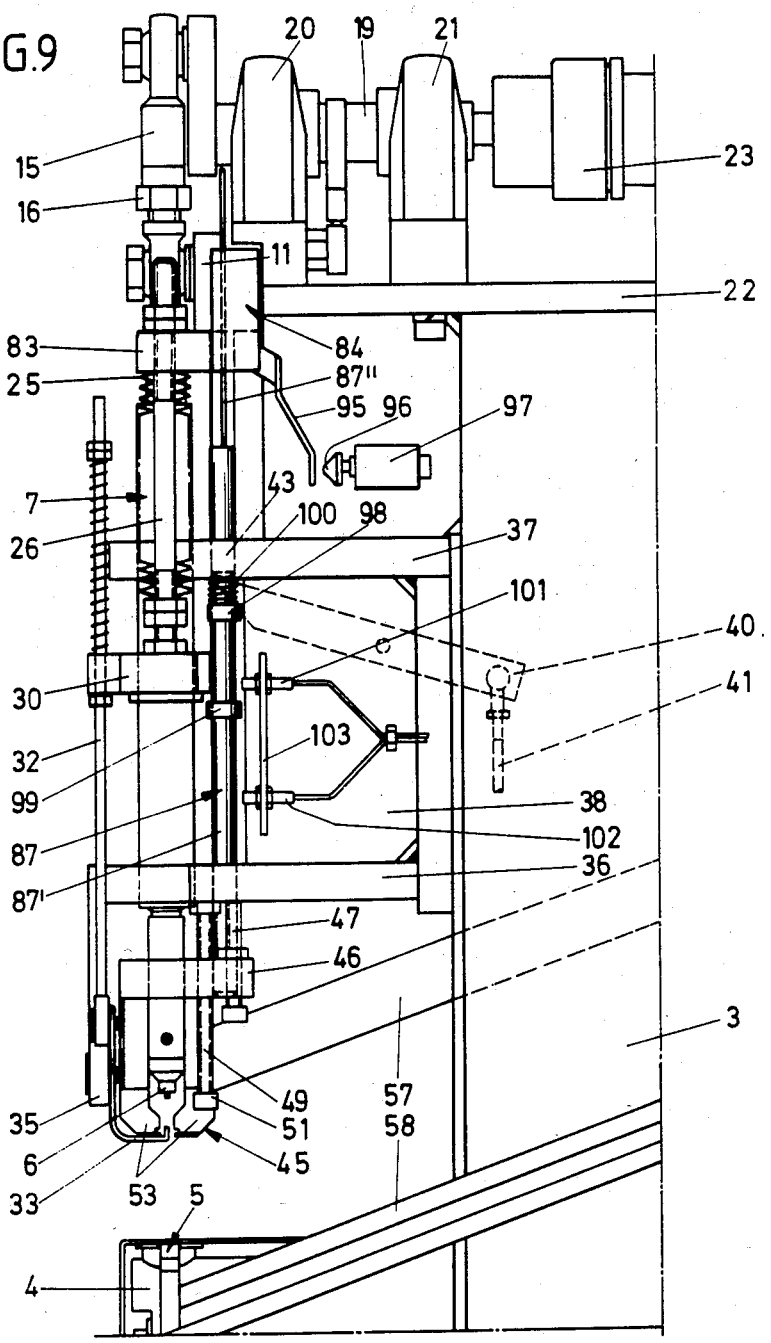
FIG. 9, a view of the upper area of the machine according to the second embodiment, in home position.
Figure 10:
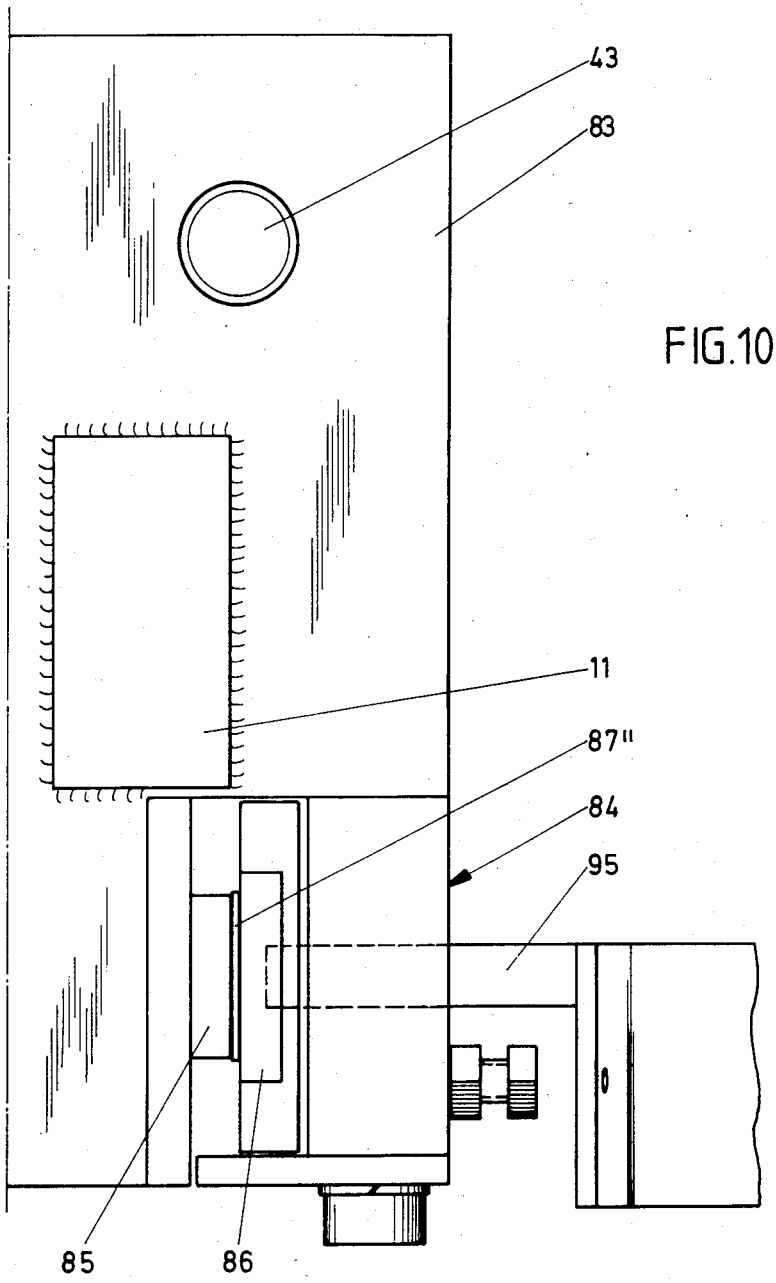
FIG. 10, is an enlarged plan view of the force application plate with the brake shoe housing supported by it and with the automatically closing brake jaw in braking position.
Figure 11:
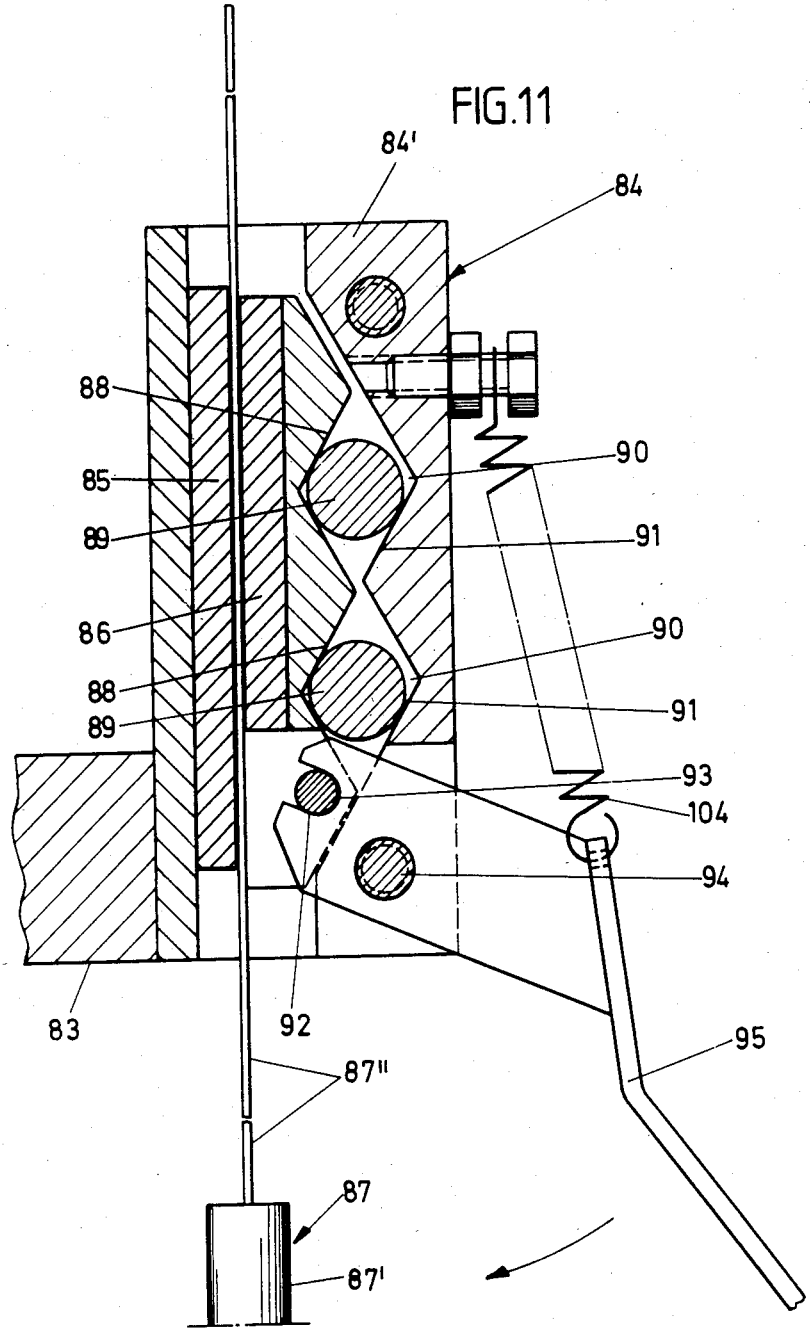
FIG. 11, is an enlarged cross-sectional view of the brake shoe in braking position.
Figure 12:
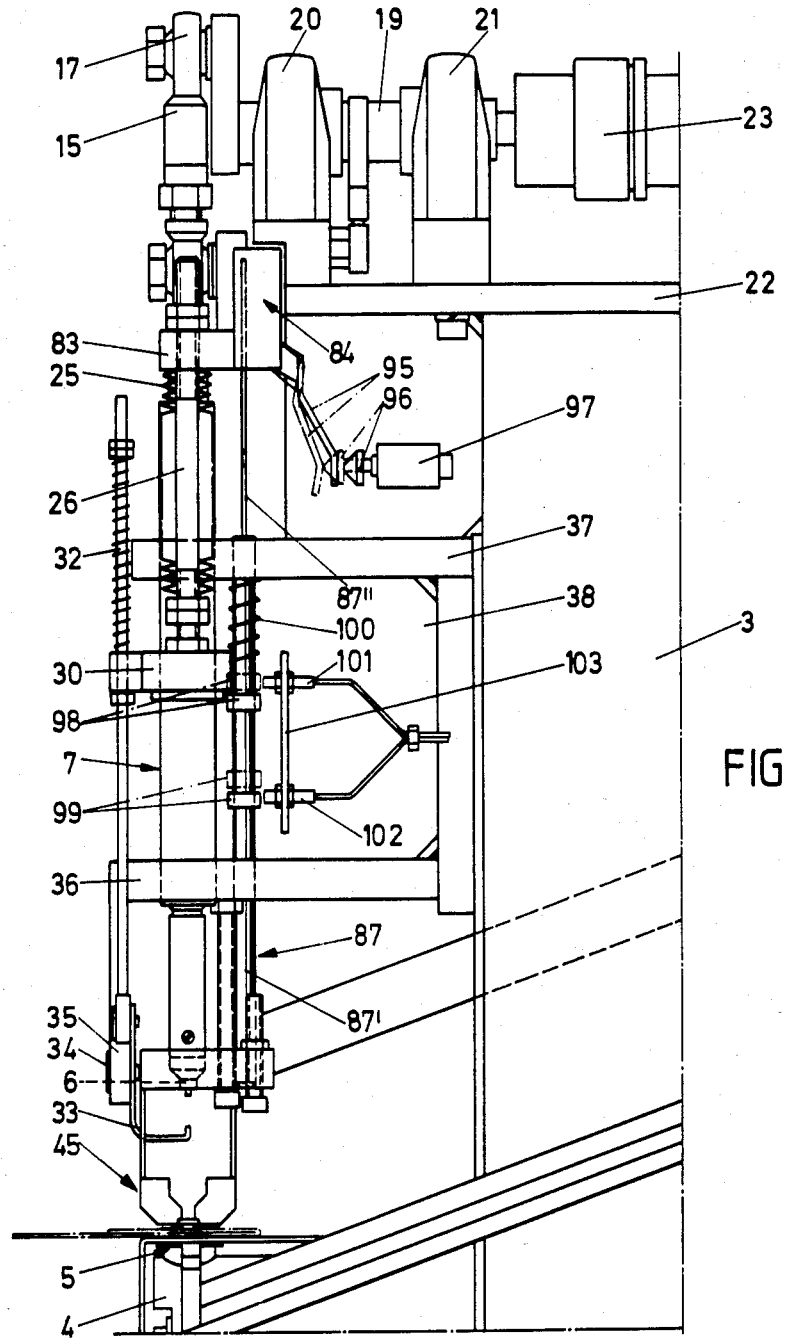
FIG. 12 is an elevational view corresponding to FIG. 9, where the guide rod with tongs has been released for down movement by the swing lever solenoid.
Figure 13:
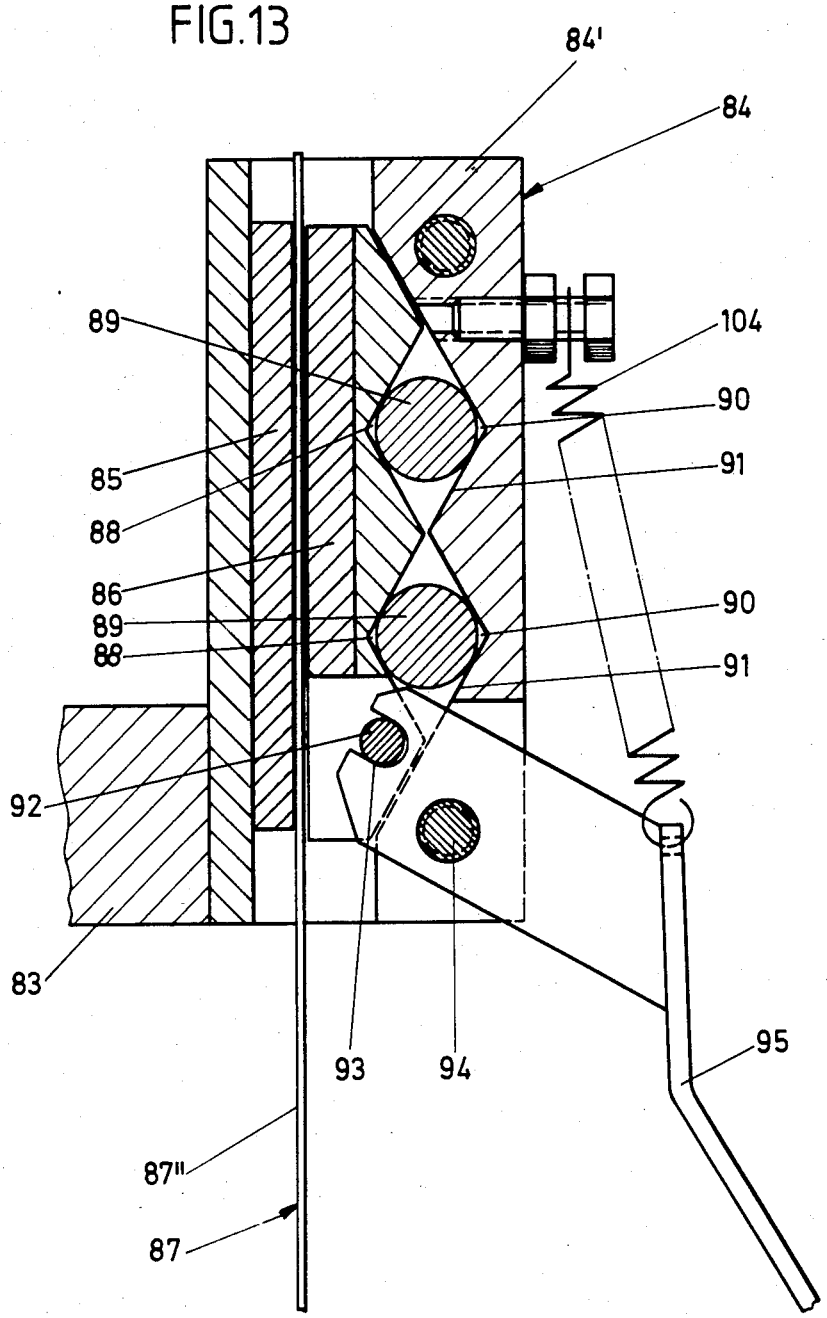
FIG. 13 is a cross-sectional view corresponding to FIG. 11, but with the release lever moved.

Illustrated in FIGS. 9 through 13, a second embodiment uses identical reference numerals for identical components. The force introduction plate 83 supports a brake shoe 84. The housing 84' of the latter comprises a fixed vertical brake jaw 85 which is opposed by an automatically closing brake jaw 86. Extending between the jaws 85, 86 is the guide rod 87 composed of a lower tubular section 87' and an upper flat steel section 87'' connected with the lower section 87' in such a way that it extends between the brake jaws 85, 86. The tubular section 87' supports the tongs 45.

On the back side, the automatically closing brake jaw 86 features two wedge type recesses 88 receiving a roll body 89 each. The wedge type recesses 88 are opposed by wedge type recesses 90. The latter form bevels 91 tapering down toward the fixed brake jaw, on which recesses 90 bear the roll elements 89. The bottom end of the automatically closing brake jaw 86 is forked, and a pin 92 extends through this forked area. This pin engages a slot 93 which is open on one side, of a release lever 95 mounted on a pivot of the brake shoe housing 84'. Attached to the release lever 95 is a tension spring 104, stressing it counterclockwise and forcing the automatically closing brake jaw, due to the roll bodies 89 and the bevels 91, into braking contact position with the flat steel section 87''. The guide rod 87 is thereby held in its position. Downward stresses acting on the guide rod 87 lead to an increase of the brake force. The lower end of the release lever 95 designed as a swing lever extends in front of the core 96 of the solenoid 97.

The guide rod 87 supports below the upper bearing plate 37 two switching elements 98, 99 which are arranged one above the other with a space in between. These switching elements are designed as set collars and are adjustable in height.

A compression spring 100 extends between the upper switching element 98 and the bearing plate 37, on the guide rod. This spring stresses the guide rod 87 in down direction, in the home position according to FIG. 9.

The switching elements 98, 99 interact with machine-fixed counterparts 101, 102 which are fashioned as inductive limit switches. These are mounted on a machine-fixed support 103 permitting an adjustment of the counterparts 101, 102 in vertical direction. The arrangement of the upper opposite switching part 101 is such that it is located closely above the lower switching element 99. The spacing between the two opposite switching elements 101, 102 is greater than the space between the switching elements 98, 99.

The operating mode of the machine according to the second embodiment is as follows: Once the lower tool 5 and the tong jaws 53 are loaded with rivet parts, the foot switch 81 is operated. This causes the solenoid 97 to receive a pulse through which its core 96 moves in the dash-dotted position according to FIG. 12. In turn, the release lever 98 is moved clockwise on its pivot 94. As a result, the automatically closing brake jaw 86 is shifted parallel to itself through the pin/slot engagement, assuming the position according to FIG. 13. The roll bodies 89 are able to escape into the recesses 90 in the brake shoe housing 84'. With no braking force exerted on its anymore, the guide rod 87 is permitted to drop with the support of a compression spring. The upper switching element 98 passes in this process the upper opposite switching element 101 causing the swing lever solenoid 97 to assume its release position. The tension spring 104 can now become effective which, in turn, moves the release lever 95 counterclockwise, returning the automatically closing brake jaw into its braking position. Thus, the remaining drop of the tongs is retarded. Once at standstill, the guide rod 87 extends with its upper end between the brake jaws 86, 87 while the lower switching element 99 opposes the opposite switching element 102. This causes the drive motor 24 to receive a pulse and to rotate the crankshaft 19 in conjunction with a down motion of the telscopic ram guide 7. The force application plate 83 is entrained during the down motion. Due to the special design of the automatically closing brake jaw 86, no appreciable braking force is asserted, making a relative shift between brake shoe and guide rod possible. But as the upper tool ram 7 subsequently moves upward, the guide rod 87 with the tongs 45 is entrained again, the upward motion of the guide rod 44 being limited by the adjustable stop 47. The drive can be shut off during the upward stroke by way of a not illustrated limit sensor, and the brake coordinated with the drive can be activated. Thereafter, the home position is in effect again.

From the foregoing disclosure of the general principles of the present invention and the above disclosure of a preferred embodiment, those skilled in the art will comprehend various modifications to which the invention is susceptible. Therefore, I desire to be limited only by the scope of the following claims. In the claims it is to be understood that "fastener" is used in a generic sense to refer to buttons, rivets or the like.

Having described my invention, I claim:

1. A machine for attaching fasteners, said machine comprising:

an upper tool, a lower tool, said upper tool being movable toward said lower tool;

an upper tool ram, means interconnecting said upper tool ram and said upper tool for moving said upper tool with said ram toward said lower tool;

a guide rod, means mounting said guide rod for reciprocating movement in a vertical direction in coordination with said upper tool;

holding tongs for said fasteners, means interconnecting said holding tongs and said guide rod for movement therewith;

braking means engageable with said guide rod, said braking means being interconnected to said upper tool ram;

an operating switch, means responsive to actuation of said operating switch for initiating downward movement of said guide rod and said tongs toward said lower tool;

a second switch for controlling actuation of said upper tool ram when said tongs are shifted to a predetermined lower limit position.

2. The machine of claim 1 in which said brake means comprises a brake shoe, said brake shoe releasably engaging said guide rod when said upper tool ram is in its lower position.

3. The machine of claim 2 further comprising a stationary abutment;

an adjustable stop interconnected to said guide rod and being disposed for abutment with said stationary abutment, whereby the upward motion of the guide rod is limited by engagement of said adjustable stop with rod abutment irrespective of the upward motion of said upper tool ram.

4. The machine of claim 2 in which said brake means comprises two jaws, said machine further comprising means for adjusting the braking force applied by said two jaws.

5. The machine of claim 2 in which said brake shoe comprises an automatically closing brake jaw, said guide rod extending in contact with said brake jaw, and normally being held against downward movement, but being free to move in an upward direction through the brake shoe.

6. The machine of claim 5 further comprising a brake housing having a plurality of bevels;

members engaging said brake jaw and said bevels on said brake shoe housing, whereby downward pressure on said brake jaw will cause said brake jaw to be shifted toward the braking position.

7. The machine of claim 5 further comprising a release lever, means interconnecting said lever with said automatically closing brake jaw, whereby said brake jaw can be shifted by said release lever to a release position, permitting movement of said guide rod.

8. The machine of claim 7 further comprising a solenoid, said release lever being pivotally mounted and being shiftable by said solenoid, said brake jaw being disposed substantially parallel to a portion of said lever and carrying a pin, a member carried by said lever and having a slot in engagement with said jaw.

9. The machine of claim 8 further comprising first and second switching elements carried by said guide rod;

first and second stationary cooperating switch members, said first and second switching elements being disposed for actuation of said first and second stationary cooperating switch members when said guide rod is disposed in its lowermost position, said first stationary cooperating switch member being effective to control said solenoid to release said brake shoe to its released position.

10. The machine of claim 1 in which said means for causing movement of said guide rod comprises a solenoid having a core;

said operating switch being effective to energize said solenoid, whereby said core of said solenoid is shifted in a downward direction;

means for interconnecting said guide rod and said solenoid core, whereby said solenoid core shifts said guide rod downwardly releasing said guide rod from said brake means.

11. The machine of claim 10 in which said means for interconnecting said solenoid core and said guide arm rod comprises an arm carried by said guide rod and a springed pressure component mounted on said arm, said core engaging said springed pressure component.

12. The machine of claim 11 further comprising a stationary cushion, said arm mounted on said guide rod engaging said cushion to stop downward movement of said tongs.

13. The machine of claim 10 further comprising an adjustment finger mounted upon said arm;

said second switch being disposed for engagement by said adjustment finger.

* * * * *